United States Patent [19]

Steers et al.

[11] Patent Number: 4,870,235

[45] Date of Patent: Sep. 26, 1989

[54] MICROWAVE OVEN DETECTING THE END OF A PRODUCT DEFROSTING CYCLE

[75] Inventors: Michel Steers, La Queue-En-Brie; Gilles Delmas, Paris; Jean-Pierre Hazan, Sucy-En-Brie, all of France

[73] Assignee: U.S. Philips Corporation, New York, N.Y.

[21] Appl. No.: 202,161

[22] Filed: Jun. 2, 1988

[30] Foreign Application Priority Data

Jun. 2, 1987 [FR] France ..... 87 07684

[51] Int. Cl.[4] ..... H05B 6/68

[52] U.S. Cl. ..... 219/10.55 B; 219/10.55 F; 374/149; 99/451; 99/325

[58] Field of Search ..... 219/10.55 B, 10.55 F, 219/10.55 A, 10.55 R, 10.55 E, 494, 510; 374/149, 133; 99/DIG. 14, 451, 325; 340/589

[56] References Cited

U.S. PATENT DOCUMENTS 3,478,187 11/1969 Agdur et al. ..... 219/10.55 R
4,367,388 1/1983 Ishihara et al. ..... 219/10.55 B
4,434,342 2/1984 Schubring ..... 219/10.55 B
4,626,643 12/1986 Minet ..... 219/10.55 B

FOREIGN PATENT DOCUMENTS 2571830 4/1986 France .

*Primary Examiner*—Philip H. Leung
*Attorney, Agent, or Firm*—Algy Tamoshunas; Leroy Eason

[57] ABSTRACT

A microwave oven includes a microwave source and a defrost detector arranged in the oven cavity in the proximity of a frozen product to be processed, the absorption of microwave energy being distributed between the detector and the product and causing their temperature to rise, the temperature variation of the detector being measured by a measuring element producing a corresponding electrical signal. The oven also includes a computing control device which determines completion of defrosting of the product by computing the values at successive instants of the second derivative of such signal as a function of time. The computing control device controls the oven at the end of the defrosting cycle, which is when the value of such second derivative falls below a predetermined value.

7 Claims, 5 Drawing Sheets

FIG.3
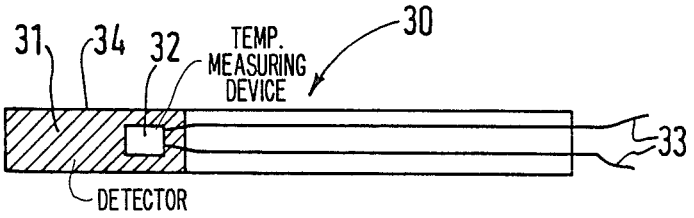
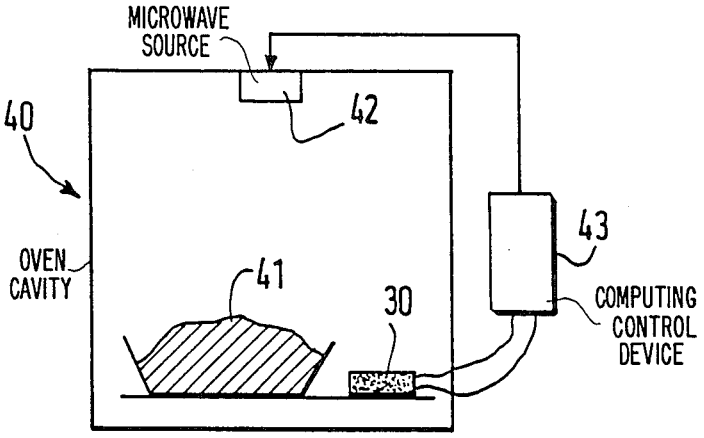
FIG.4a

MICROWAVE OVEN DETECTING THE END OF A PRODUCT DEFROSTING CYCLE

FIELD OF THE INVENTION

The invention relates to a microwave oven comprising a microwave source and a detector arranged in the oven in the proximity of a product to be processed, the absorbed microwave energy being distributed between the detector and the product, thereby causing their temperature to rise, the temperature of the detector being measured by a measuring element.

BACKGROUND OF THE INVENTION

Currently microwave ovens are often used for defrosting and reheating foodstuffs which have been previously kept in a freezer. In general, this defrosting is effected empirically i.e. the user determines the approximate weight of the food to be defrosted in order to derive an approximate operating time for the microwave oven. This results in more or less complete defrosting or even a beginning of cooking.

It is also known from the literature that around 2.45 GHz, the microwave absorption of water, which is the principal constituent of most foodstuffs, differs considerably depending on whether the water temperature is below or above 0° C. The ice below 0° C. is highly transparent to microwaves and the water at a temperature above 0° C. has a very strong microwave absorption. This effect is caused by variations of dielectric losses of water as a function of temperature. French Patent 2,571,830 describes a microwave oven provided with a standard load placed in the oven beside the food to be processed. The standard load absorbs microwave energy in accordance with a distribution which depends on the standard load and the load of food to be processed.

Thus, from the rise in temperature of the standard load it is possible to derive the quantity of food present in the oven and to automatically determine the cooking time. According to said patent the rate of heating of the standard load is substantially independent of the temperature of the detector.

Although a defrosting operation is mentioned therein said patent does not reveal any means for detecting the critical transition from a frozen condition to a defrosted condition of the food to be processed, or how the defrosting can be detected and controlled.

SUMMARY OF THE INVENTION

The technical problem to be solved by the invention is therefore to follow the variation in temperature of the product to be defrosted and to detect the end of the defrosting cycle in order to proceed to a subsequent operation.

This technical problem is solved in that the oven comprises a computing control device which determines the end of the product defrosting cycle by computing the values of the second derivative of the curve representing the temperature rise of the detector as a function of time and which controls the operation of the oven at the end of the defrosting cycle when the value of the second derivative becomes smaller than a predetermined value.

Thus, the oven can be programmed either manually or automatically to proceed to a subsequent cooking operation or to stop if only a defrosting cycle is required.

In a microwave oven the temperature rise of a load as a function of time obeys a calorimetric-type relationship $$\Delta\theta = P.\Delta t/mc$$

where $\Delta\theta$ is the temperature variation during the time interval $\Delta t$ for a mass m of a body having a specific heat c, and p is the microwave power available in the oven.

Experiments have shown that this relationship is also valid if said mass is divided into two masses $m_1$ and $m_2$ such that $m = m_1 + m_2$.

The relationship then becomes:

$$m_1\Delta\theta_1 + m_2\Delta\theta_2 = m\Delta\theta \quad (1)$$

$\Delta\theta_1$ and $\Delta\theta_2$ then are the temperature rises of the two masses $m_1$ and $m_2$ and $\Delta\theta$ is the temperature rise of the mass m if it has been exposed to microwaves in the oven under the same conditions as the masses $m_1$ and $m_2$, in particular for the same heating period. This relationship is still valid when two masses of different specific heat are placed in the oven:

$$m_1c_1\Delta\theta_1 + m_2c_2\Delta\theta_2 = mc\Delta\theta \quad (2)$$

It follows from these relationships that if two loads are simultaneously placed in a microwave oven the total power available will be distributed between the two loads in such a way that the temperature of each load is raised by a value which is inversely proportional to its mass and to its heat capacity. Thus, if the thermodynamic characteristics of one of the loads are known, the temperature variation of the defrosting detector will depend on the presence and the thermodynamic state of the product to be defrosted. The detector should have well-defined and stable thermodynamic parameters.

However, the law represented by relationships (1) or (2) relates to substances for which the microwave absorption is the same. If this is not the case, the temperature rise of the substance of the mass $m_1$ and that of the substance of the mass $m_2$ will consequently change. In particular, if one of the substances is ice, as in the situation envisaged by the invention, its absorption coefficient will be very small. Therefore the microwave energy will be absorbed mainly by the detector itself, which is constructed to have a suitable absorption coefficient. The transition of the substance from the ice state to the water state results in the substance progressively absorbing more and more microwave energy, i.e. being heated increasingly. Consequently, the energy absorbed by the detector decreases progressively. Thus, the variation of the detector temperature will enable the variation in temperature of the product being defrosted and placed in its proximity to be followed. Therefore, the rate of heating of the detector will not be substantially independent of its temperature, as indicated in the Patent FR 2,571,830, but on the contrary it will be indicative of the change in thermodynamic state of the substance of the product.

The rise in temperature of the detector will depend on the state of the product to be defrosted. In particular, if the product which by nature contains much water is taken from the freezer at a temperature of approximately −20° C., its microwave absorption will only be very low. Consequently, all the power available in the microwave oven will be utilized to raise the temperature of the detector. As soon as the process of defrosting the product sets in, the product will absorb more and more microwave power and consequently the temperature of the detector will rise less rapidly. The slope (first derivative) of the curve representing the temperature rise of the detector as a function of time will therefore decrease constantly until all the ice present in the product to be defrosted has been transformed completely to water. Consequently, in accordance with the calorimetric law governing the temperature rise in a microwave oven as a function of time, the temperature rise of the product will be a linear function of time if the thermodynamic characteristics of the product do not vary.

In order to determine the temperature variations of the detector the temperature measuring element supplies an electric signal whose variations as a function of time correspond to such temperature variations signal. These signal variations are processed by the computing control device, which compares said variations as a function of time at successive instants. Thus it determines the values of the second derivative of the curve representing the variation in time of the detector temperature as measured by the measuring element. Subsequently, the device acts to control the operating cycle of the microwave source when two successive values of said variations are substantially equal, i.e. when the values of the second derivative are smaller than a predetermined value.

The presence of the detector makes the power selection switch of the oven redundant. Indeed, at the beginning it is adequate to operate the oven with a low microwave power repetition rate and to measure the slope (first derivative) of the curve representing the temperature rise of the detector as a function of time. If this slope decreases (with an absolute value of the second derivative larger than the predetermined value) the product in the oven is still defrosting. If said slope becomes moderate (with an absolute value of the second derivative smaller than the predetermined value) the oven can be automatically controlled to increase its microwave emission rate because the product in the oven has been defrosted and merely has to be reheated.

The criterion to stop the defrosting cycle should allow for the fact that if the product to be defrosted consists substantially of ice the first derivative may be constant and thus resemble that of a product already defrosted. The distinction is then made by means of the value of the second derivative: (a) if it is substantially equal to that of the detector alone, the product in the oven is frozen; and (b) if it is substantially smaller the product in the oven is already defrosted.

When a very high detection sensitivity is required at the beginning of the defrosting cycle it is possible to use a liquid substance, for example oil, whose heat capacity and/or microwave absorption decrease very strongly with the temperature. If the product is then still frozen the temperature of the liquid will rise very rapidly and as soon as defrosting begins a very distinct plateau will occur in the curve representing the detector temperature as a function of time. This effect is caused by the very strong decrease of the product $mc\Delta\theta$ of the detector. It may also be considered to use a plurality of detectors having different thermodynamic characteristics.

Since the product to be defrosted generally contains a large amount of ice, the material of the defrosting detector should exhibit dielectric losses higher than the dielectric losses of ice.

The detector material may be a liquid such as water, oil or a solid, or it may be arranged on a non-absorbing carrier. It may be situated in a vessel which is transparent to microwaves.

The defrosting detector may be removable or may be fixedly connected to the microwave oven. When it is removable it can easily be taken out for cleaning and positioned at an arbitrary location in the cavity. It can also be fixedly connected to the oven and form an integral part of the oven. In that case it may be formed by a liquid circulating in a closed system, the element for measuring the temperature variations determining the difference in temperature between the input and the output of the system. Circulation can be achieved by means of a pump.

BRIEF DESCRIPTION OF THE DRAWINGS

Embodiments of the invention will now be described in more detail, by way of example, with reference to the accompanying drawings, in which:

FIG. 3 shows diagrammatically a detector.

FIG. 4*a*, FIG. 4*b* and FIG. 4*c* show diagrammatically three microwave ovens comprising different detectors.

In FIG. 1*a* the curve 10 represents the temperature variations of a detector constituted by a mass $m_1$ of 100 grams of water and the curve 11 represents the temperature variations of a product consisting of a mass $m_2$ of water, both placed in a microwave oven for temperatures above the ambient temperature and for a length of time which depends on the mass $m_2$. The temperature rise of the two masses decreases as the mass $m_2$ increases. The rise in temperature of the mass $m_1$ of the detector is greater than that of the larger mass $m_2$.

FIG. 1*b* represents is the temperature variation 12 of a mass of $m_1+m_2$ grams of water. The curve 13 is formed by points obtained by computing the temperature rise of a mass $m_1+m_2$ grammes of water by means of equation 1. It is found that the two curves coincide. This demonstrates that the microwave energy dissipated in the form of heat is distributed in the two loads in such a way that their temperatures rise in inverse proportion to mass and specific heat of each load. The temperature rise of the detector thus enables the temperature rise of the product situated in its proximity to be determined and, in particular, the defrosting cycle to be monitored.

FIG. 2*a* represents the temperature variations 21 as a function of time for a detector consisting of water during defrosting of a mass of 200 grammes of ice. The slope (first derivative) of the curve 21 is represented by the curve 22. The slope of the curve 22 (the second derivative of the curve 21) is represented by the curve 25. It is found that at the beginning said first derivative has a large absolute value which initially decreases slowly and subsequently rather rapidly until it finally stabilises. This stabilisation is utilised in order to detect the end of the defrosting cycle by means of the computing and control device. The second derivative 25, represented by straight lines, initially increases and subsequently decreases in absolute value during the defrosting cycle. When this cycle is completed the second derivative has a small value. When this value becomes smaller than a predetermined value the computing and control device may act to set the oven to another mode of operation: cooking, slow reheating up, off, etc. . .

FIG. 2*b* shows a curve similar to that in FIG. 2*a*. The first and second derivatives are determined by means of a more accurate computing process. The curve 1 represents the temperature variation of the detector. The curve 2 represents the first derivative of the curve 1. The curve 3 represents the second derivative of the curve 1. The zero levels for the curves 2 and 3 are indicated in the right-hand part.

DESCRIPTION OF THE PREFERRED EMBODIMENTS

Figure 1A:
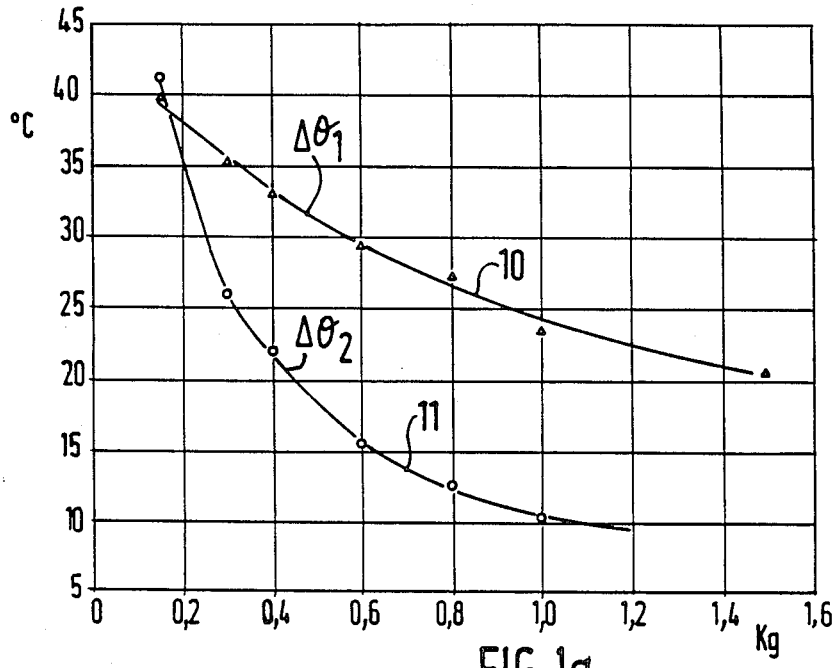
FIG. 1*a* shows curves representing variations in temperature of a detector having a mass $m_1 = 100$ grams and a product having a mass $m_2$, both consisting of water in the liquid state, as a function of the mass $m_2$.
Figure 1B:
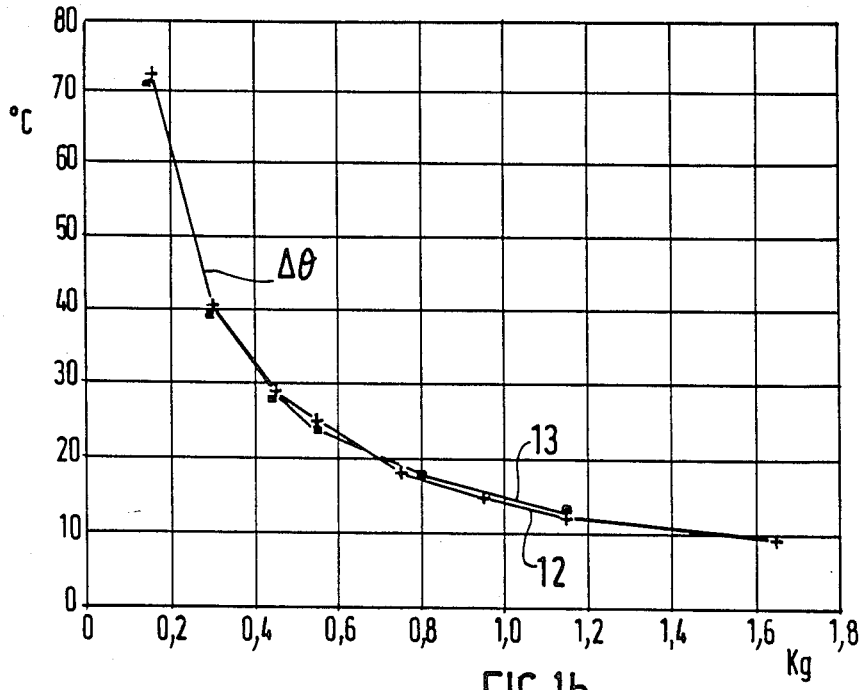
FIG. 1*b* shows curves illustrating the agreement between the results of experimental temperature measurements carried out on a mass $m_1 + m_2$ and those computed by means of equation 1.
Figure 2A:
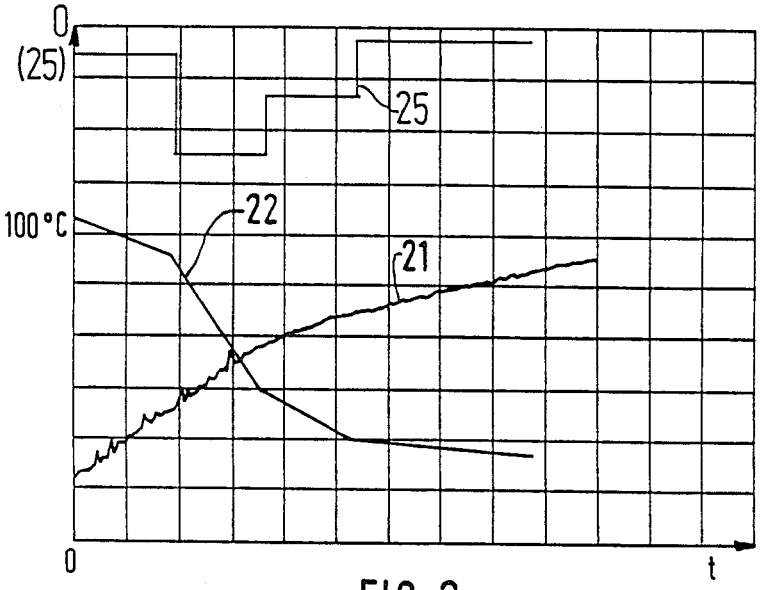
FIG. 2*a* shows curves representing the temperature and temperature variations curves as a function of time for a detector consisting of water, arranged beside a product to be defrosted and consisting of a mass of ice during defrosting of the mass of ice.
Figure 2B:
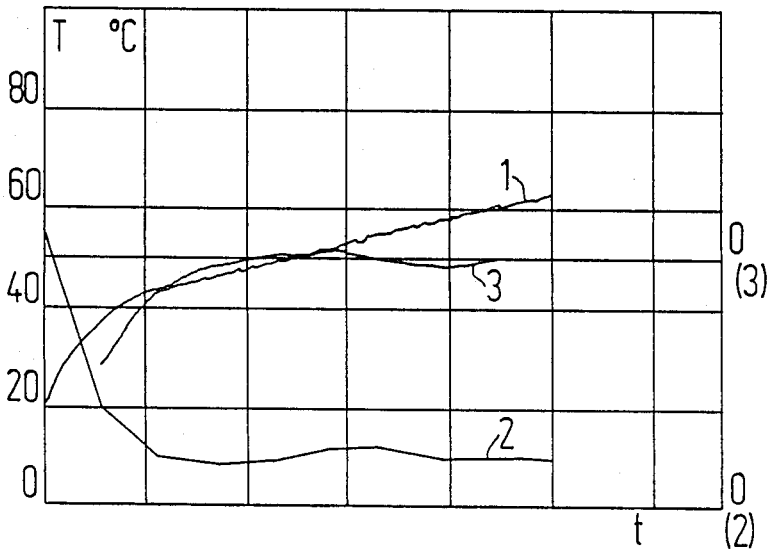
FIG. 2*b* is a curve similar to that shown in FIG. 2*a* and representing the end of a product defrosting cycle, the computation step used for the measurement of the first and second derivatives being more accurate.

FIG. 3 shows a non-limitative example of a defrosting detector 30. It consists of a substance 31 which can absorb microwaves, the substance being in contact with an element 32 for measuring its temperature. This element may be thermocouple, a thermistor, a semiconductor detector or any other temperature-measuring element. The element is connected to external circuitry by leads 33. The substance 31 may be a liquid. It is then contained in a vessel or receptacle 34. The substance 31 may also be a solid. In that case it may be placed in a receptacle 34. The substance may also be deposited on a carrier which does not or hardly absorbs microwaves.

The liquid substance may be water, oil or any other liquid having dielectric losses such that a satisfactory heating of the detector is ensured.

The solid substance may be ferrite, a solid containing metal ions, or any other solid having dielectric losses such that a satisfactory heating of the detector is ensured.

FIG. 4*a* shows a microwave oven 40 equipped with a defrosting detector 30. The detector is placed beside the product 41 to be defrosted. A microwave source 42 emits microwaves to which the product 41 and the detector 30 are exposed. The result of the measurement of the temperature of the detector 30 is transmitted to a computing control device 43, which acts to control the operation of the microwave source.

Figure 4B:
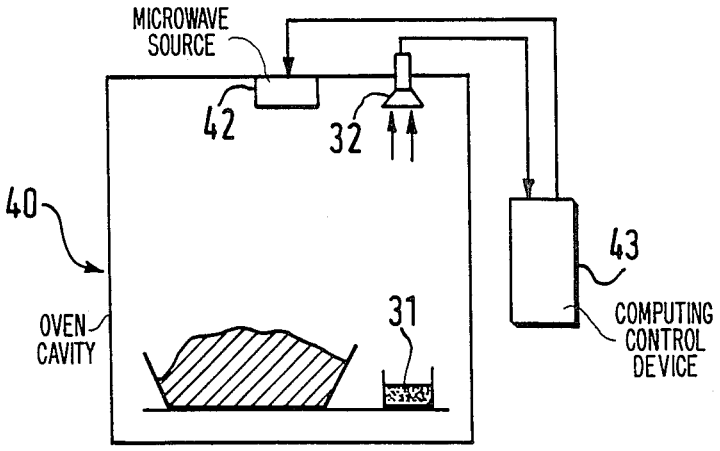

FIG. 4*b* shows another microwave oven in which the defrosting detector comprises a substance 31 which is separated from the temperature measuring element 32. Said element comprises an infrared radiation detector of the pyroelectric type. In this way the temperature of detector 31 is determined by a remote measurement. The measurement signal is transferred to the computing and control device 43, which influences the microwave source 42.

Figure 4C:
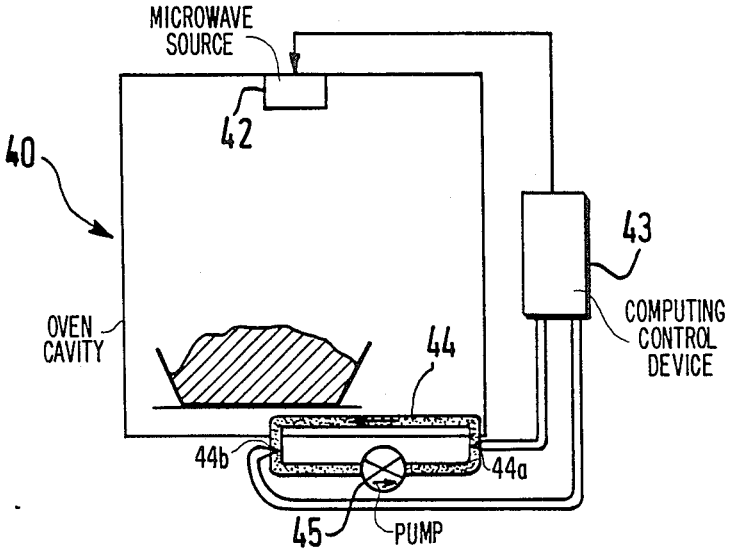

FIG. 4*c* shows another microwave oven 40 in which the detector consists of a closed circulatory loop containing a liquid, a part of said loop being situated in the oven cavity. Circulation can be achieved by means of a pump 45. Two temperature measuring elements detects the temperatures at the input 44*a* and the output 44*b* of the part of the loop situated in the cavity and transfer that data to the computing control device 43, which controls the microwave source 42.

Figure 5:
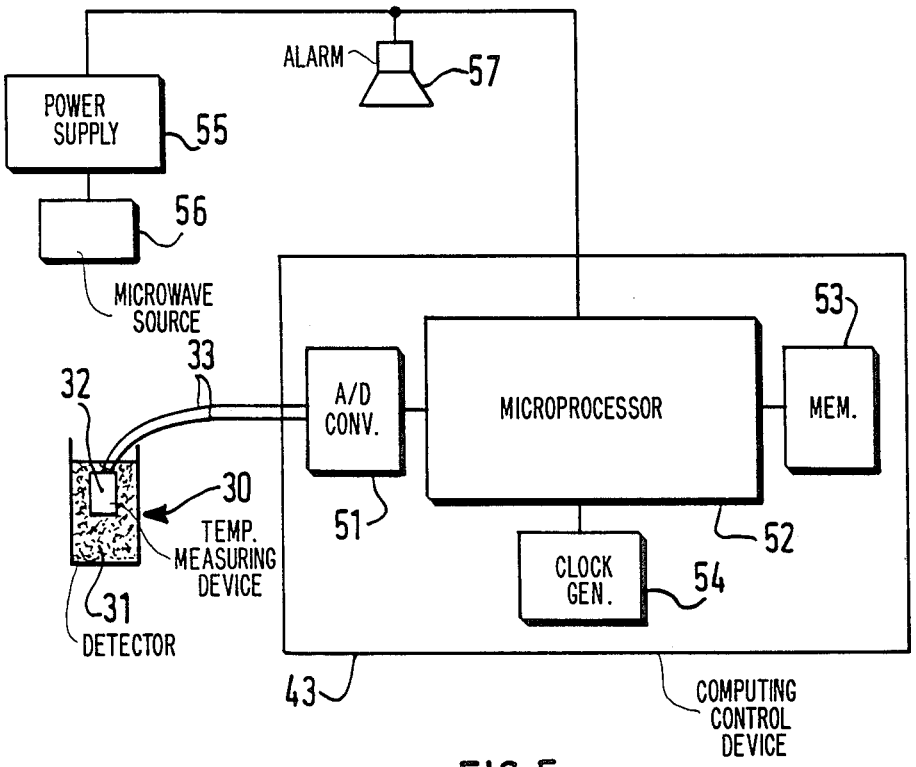
FIG. 5 is a diagram illustrating the electric circuit arrangement for controlling the operation of the microwave source in response to measurements performed by the detector in order to control the defrosting process in accordance with the invention.

FIG. 5 shows an electric circuit arrangement for controlling the operation of the microwave source in response to the measurements effected by means of the detectors. The electric signals from the detector 30 are applied to the computing control device 43. An example of said device comprises an A/D converter 51 connected to a microprocessor 52 with a memory 53. It operates with a clock generator 54. The microprocessor 52 determines the variations in slope of the electric signal which it receives and stores the values in the memory 53. The value at the instant t is compared with that determined at the instant t - 1 and, if the two consecutive values are substantially equal, the microprocessor influences the power supply 55 of the magnetron 56 constituting the microwave source. An alarm 57 can indicate the progress of the operation.

The operating principle is as follows. The temperature of the detector is converted into an electric signal which is converted into a digital signal by means of an analog-to-digital converter. This signal is subsequently stored in a RAM and processed by the microprocessor. In the case of defrosting processing consist of measuring the temperature at fixed time intervals and comparing the different measurement values with each other in order to determine a slop (first derivative) of the curve representing the rise in temperature of the detector as a function of time, and subsequently determining the variation (second derivative) of said slope. For example, during a complete defrosting cycle a temperature measurement may be carried out every two seconds and the rate at which the temperature rises may be measured after every 100 temperature measurements by a method such as the least-squares method. Such a measurement then yields a variation in slope as a function of time, whose characteristics may be as follows in the case of a body containing a large amount of water.

Initially the load is frozen. The rise in temperature of the detector is rapid and follows a curve which would be identical if the detector alone were present. Under these conditions the slope measured by the least-squares method is substantially a straight line substantially parallel to the time axis.

Subsequently the load begins to defrost. The rise in temperature of the detector is less rapid. The curve of the slope as a function of time then has a negative derivative.

When the load is defrosted completely the rise in temperature of the detector becomes again monotonic with a more moderate slope than at the beginning of the operation when no change of phase occurs, such as boiling. In the least-squares curve this effect manifests itself as a stabilisation of the curve, which stabilised portion extends parallel to the time axis. The microprocessor recognises this new stabilisation as the end the defrosting cycle. By means of suitable input/output interfaces the microprocessor can then turn off the microwave source, and if desired, provide an indication to the user or start a reheating cycle.

What is claimed is:

1. A microwave oven which provides controlled defrosting of a frozen product, comprising a microwave source and a detector arranged in the oven cavity in the proximity of such product, the detector including a material which absorbs microwave energy, the absorption of microwave energy by the detector material and by the product causing their temperatures to rise, variations in the detector temperature being measured by a measuring element producing an electrical signal corresponding thereto; characterized in that:

said oven comprises a computing control device connected to said temperature measuring element for determining from the variations in said signal when defrosting of said product has been completed, and for then controlling the operation of said oven;

said computing control device being adapted to compute the values at successive instants of the second derivative of said signal as a function of time, and to determine completion of defrosting of said product when the value of said second derivative falls below a predetermined value.

2. A microwave oven as claimed in claim 1, characterized in that the computing control device comprises an analog-to-digital converter for converting said signal to digital form and a microprocessor which receives the digitized signal from the converter and determines the values of the second derivative thereof at successive instants, said microprocessor having a memory for storing the values of said second derivatives.

3. A microwave oven as claimed in claim 1 or 2, characterized in that the detector comprises a solid material absorbing microwaves.

4. A microwave oven as claimed in claim 1 or 2, characterized in that the detector comprises a liquid material absorbing microwaves.

5. A microwave oven as claimed in claim 4, characterized in that said liquid material circulates in a closed loop having an input and an output, and said temperature measuring element determines the different in temperature between the input and output of said circulatory loop.

6. A microwave oven as claimed in claim 1, characterized in that said temperature measuring element is any of a thermistor, a thermocouple or a semiconductor detector.

7. A microwave oven as claimed in claim 1, characterized in that said temperature measuring element is an infrared radiation detector of the pyroelectric type.

* * * * *